US005427558A

United States Patent [19]

Knudsen et al.

[11] Patent Number: 5,427,558

[45] Date of Patent: Jun. 27, 1995

[54] TOY BUILDING ELEMENT WITH A SPRING MECHANISM

[75] Inventors: Jens N. Knudsen; Finn D. Madsen, both of Billund, Denmark

[73] Assignee: Interlego AG, Baar, Switzerland

[21] Appl. No.: 70,408

[22] PCT Filed: Dec. 3, 1991

[86] PCT No.: PCT/DK91/00371

§ 371 Date: Jun. 29, 1993

§ 102(e) Date: Jun. 29, 1993

[87] PCT Pub. No.: WO92/10258

PCT Pub. Date: Jun. 25, 1992

[30] Foreign Application Priority Data

Dec. 4, 1990 [DK] Denmark ..... 2873/90

[51] Int. Cl.[6] ..... A63H 33/08

[52] U.S. Cl. ..... 446/102; 446/85; 446/93; 446/95; 446/466; 446/128; 52/393

[58] Field of Search ..... 446/88, 93–95, 446/102, 466, 120, 128, 127; 52/393

[56] References Cited

U.S. PATENT DOCUMENTS

| | | | |
|---|---|---|---|
| 1,294,446 | 2/1919 | Greenstreet | 446/127 |
| 1,977,496 | 10/1934 | Snyder et al. | 52/393 |
| 2,338,803 | 1/1944 | Donofrio | 446/93 |
| 2,649,803 | 8/1953 | Andre | 446/120 |
| 2,919,476 | 1/1960 | Fritz | 52/393 |
| 3,144,731 | 8/1964 | Jones et al. | 446/466 |
| 3,162,978 | 12/1964 | Balthazor | 446/466 |
| 3,236,004 | 2/1966 | Christiansen | 446/120 |
| 3,415,007 | 12/1968 | Howe | 446/102 |
| 3,475,849 | 11/1969 | Fischer | 446/102 |
| 3,510,979 | 5/1970 | Fischer | 446/102 |
| 3,566,530 | 3/1971 | Fischer | 446/104 |
| 3,638,352 | 2/1972 | Christiansen | 446/102 |
| 3,921,348 | 11/1975 | Kurzen | 446/104 |
| 4,619,625 | 10/1986 | Seki et al. | 446/95 |
| 4,696,655 | 9/1987 | D'Andrade et al. | 446/466 |

FOREIGN PATENT DOCUMENTS

| | | | |
|---|---|---|---|
| 45526 | 2/1982 | European Pat. Off. | 446/102 |
| 1296091 | 6/1962 | France . | |
| 3737521 | 5/1989 | Germany | 446/93 |
| 3737521 | 6/1990 | Germany . | |
| 647020 | of 1962 | Italy | 446/466 |
| 1126297 | 8/1989 | Japan . | |
| 2037596 | 7/1980 | United Kingdom . | |

*Primary Examiner*—Robert A. Hafer
*Assistant Examiner*—Jeffrey D. Carlson
*Attorney, Agent, or Firm*—Kane, Dalsimer, Sullivan, Kurucz, Levy, Eisele and Richard

[57] ABSTRACT

A toy building set element is formed of a first part and a second part which is slidable and resiliently journaled with respect to the first part. Both of the parts have coupling elements thereon which permit coupling of the parts to other elements of the toy building set. One of the parts may be adapted to receive a shaft through a cylindrical opening that runs perpendicular to the displacement direction of the parts with respect to each other.

6 Claims, 2 Drawing Sheets

TOY BUILDING ELEMENT WITH A SPRING MECHANISM

BACKGROUND OF THE INVENTION

The invention concerns a toy building element incorporated in a toy building set with building elements which have mutually complementary primary and secondary coupling means for interconnecting several building elements.

It is increasingly demanded that such building sets and the building elements incorporated in Them shall be versatile and have new functions which widely imitate functions in The objects which the children imitate when playing, or which enable new uses and imaginative constructions. The present invention satisfies such a requirement.

Various inventions for spring suspension of The wheels of toy cars and toy aircrafts are known from the following patent applications: GB 2 037 596, DE 3 737 521 and JP 1126297. The inventions-described in these applications all have a quite special use and cannot be incorporated in a toy building set of the said type with known means.

SUMMARY OF THE INVENTION

The present invention, as defined in claim 1, enables a heretofore unknown function in known toy building sets, viz. that substructures can be built together by means of a simple, very compact building element and perform springing motion with respect To each other.

Claims 2 and 3 provide expedient embodiments of the building element.

Claims 4–6 state how a shaft of e.g. the wheels of a toy vehicle can be received in one of the mutually movable parts. It will hereby be possible to build cars and other vehicles where the wheels are individually spring mounted.

If an element according to the invention is arranged on each side of the toy vehicle, a through-going shaft may moreover be placed in these two elements so that the shaft is hereby spring mounted at both sides of the constructed vehicle.

BRIEF DESCRIPTION OF THE DRAWINGS

The invention will be explained more fully by the following description of exemplary preferred embodiments with reference to the drawing, in which.

DETAILED DESCRIPTION OF THE PREFERRED EMBODIMENT

Figure 1:
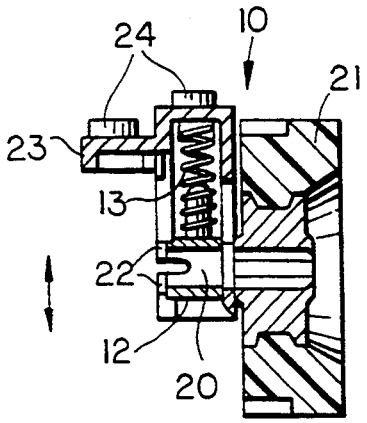
FIG. 1 is a vertical section through an element of the invention with a mounted wheel.
Figure 2:
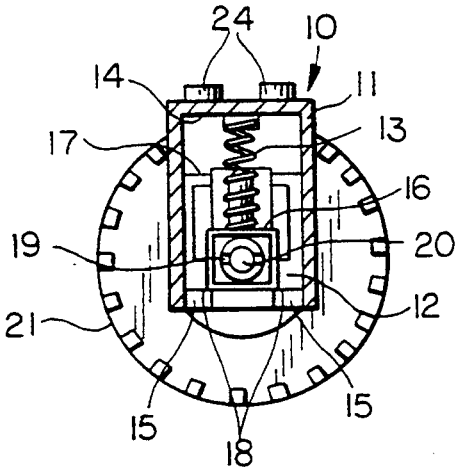
FIG. 2 is another vertical section through the element of FIG. 1.

FIGS. 1 and 2 show an element 10 of the invention, which has a first part 11 which is hollow, and whose interior accommodates a second part 12. A screw spring 13 is provided between a downwardly directed inner face 14 of the first part 11 and an upwardly directed face 16 of the second part 12, said spring exerting a force on these faces 14 and 16. The second part 12 is slidable in a vertical direction in the interior of the first part 11 between boundaries determined by the engagement of the upper face 17 of the second part against the face 14 of the first part 11 and abutment of a lower face 18 of the second part 12 against lower end stops 15 on the first part 11. These end stops 15 are provided as inwardly protruding projections.

The second part 12 has a through hole 19, and it is shown in FIG. 1 how a shaft 20 with a wheel 21 is mounted in the hole 19. At its end facing away from the wheel 21, the shaft 20 has two radially resilient flaps 22 serving as a snaplock.

The wheel 21 and its shaft 20 can freely rotate in the hole 19, and the wheel 21, the shaft 20 and the second part 12 are interconnected so as to perform the same vertical movement with respect to the first part 11 under the action of the spring 13.

It will be seen in FIG. 1 that the element 10 has a part 23 protruding laterally and displaced vertically with respect to the rest of the element. The upper side of the element is formed with cylindrical, primary coupling means 24, and the lower side of the element is formed with complementary secondary coupling means in the form of recesses permitting coupling with the primary coupling means of other elements. These secondary coupling means are of a known type and are not shown in detail.

Figure 3:
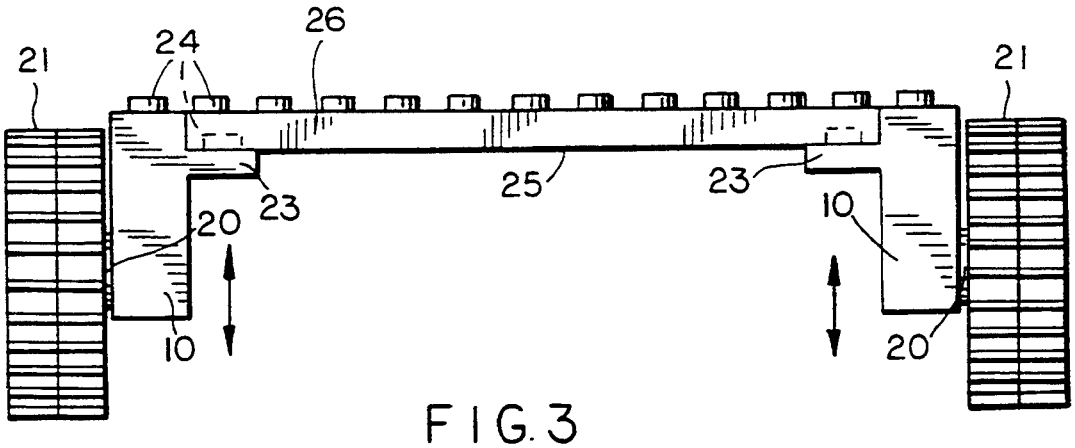
FIG. 3 shows a use of the element in FIG. 1.

FIG. 3 shows a use of the element of The invention, where two such elements 10 each with a wheel 21 on a shaft are built together by means of a building element 26 belonging to the building set and with primary coupling means 24 and secondary coupling means 25. Other building elements from the building set may be built on the building element 26 so that a complete vehicle, e.g. a car, will be built. The two wheels 21 of the car are thus individually spring mounted. The car may be provided with several such individually spring mounted wheels.

When the width of the building element 26 is varied, vehicles of different widths may be built.

The two wheels 21 in FIG. 3 may also be mounted on a common, through-going shaft.

Figure 4:
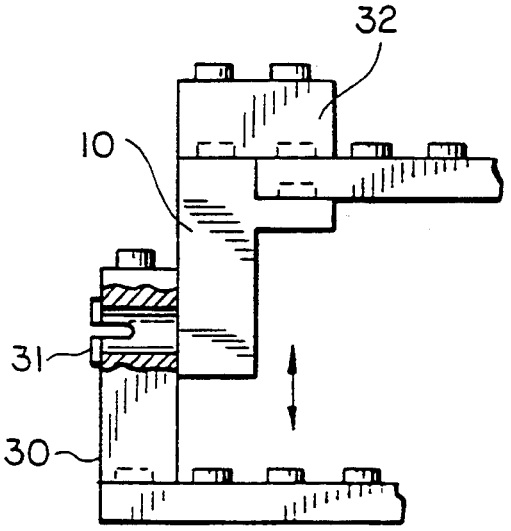
FIG. 4 shows another use of the element of FIG. 1.

FIG. 4 shows another use of the element 10 of the invention. A building element 30 has a protruding pin 31 fitting in the hole 19 in the element 10. A construction 32 consisting of elements from the building set is indicated on the element 10. The construction 32, which is firmly connected with the element 10, is thus journalled resiliently with respect to the construction part 30. It is possible to mount any number of construction parts with pins 31 in combination with elements 10 so that the built, resilient structure has the desired properties, such as e.g. stability and spring force.

Figure 5:
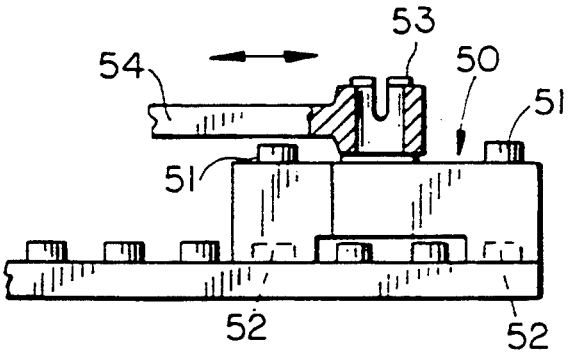
FIG. 5 shows an alternative embodiment of the element of the invention.

FIG. 5 shows another embodiment of the element of the invention. An element 50 has an internal structure like the element 10 and has primary coupling means 51 and secondary coupling means 52. A shaft 53 is mounted in a hole (not shown) in an inner and slidable part (not shown) in the element 50. A construction part 54 is shown surrounding the shaft 53 so that it can hereby perform a resilient movement, which is here transversely to the coupling direction defined by the primary and secondary coupling means 51 and 52.

Figure 6:
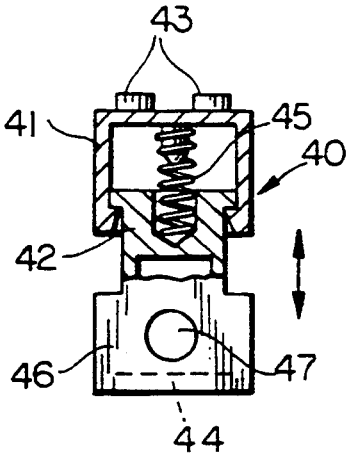
FIG. 6 is a vertical section through another alternative embodiment of the invention.

Finally, FIG. 6 shows a third embodiment of the element of the invention. An element 40 has a first part 41 and a second part 42, which are built together corresponding to the parts 11 and 12 with a spring 45. The second part 42 is downwardly extended from the first part 41 and has a foot member 46. On the upper side of the part 41 the element 40 has cylindrical projections 43 serving as primary coupling means like the means 24, and the lower side of the foot member 46 is formed with complementary secondary coupling means 44 for coupling with the primary coupling means of other building elements. The second part 42 has a through hole 47. This element 40 is incorporated as a resilient building element in the building set.

We claim:

1. A toy building set comprising:

toy building blocks, each block having a first face with at least one protruding stud and a second face opposite to said first face provided with at least one recess dimensioned to receive a protruding stud from another block in a frictional engagement;

at least one of said blocks being formed of a first part having said first face and a second part having said second face, said second part being resiliently and slidably connected to said first part for movement of said first and second faces of said at least one block toward and away from one another; and one of said first and second parts having means for mounting a wheel.

2. The toy building set in accordance with claim 1 wherein said wheel mounting means includes a wheel axle receiving through hole extending though said one of the parts.

3. The toy building set in accordance with claim 1 wherein said wheel mounting means includes a wheel receiving stud protruding from a surface of one of the parts.

4. The toy building set in accordance with claim 2 wherein said through hole extends in a direction generally perpendicular to the direction of movement of said first part with respect to said second part.

5. The toy building set in accordance with claim 15 wherein said stud extends in a direction generally perpendicular to the direction of movement of said first part with respect to said second part.

6. A toy building set comprising:

toy building blocks, each block having a first face with at least one protruding stud and a second face opposite to said first face provided with at least one recess dimensioned to receive a protruding stud from another block in a frictional engagement;

at least one block having a first part having one said first face and a second part having one said second face, said second part being resiliently and slidably connected to said first part for movement of said first and second faces of said at least one block toward and away from one another.

* * * * *